US005301831A

United States Patent [19]

Holmes

[11] Patent Number: 5,301,831

[45] Date of Patent: Apr. 12, 1994

[54] NEWSPAPER RACK WITH IMPROVED ONE-AT-A-TIME DISPENSING ASSEMBLY

[75] Inventor: Woodi N. Holmes, Vallejo, Calif.

[73] Assignee: Harold D. Messner, Vallejo, Calif.

[21] Appl. No.: 991,152

[22] Filed: Dec. 16, 1992

[51] Int. Cl.[5] ..... G07F 11/24

[52] U.S. Cl. ..... 221/28; 221/1; 221/29; 221/152; 221/155; 221/196; 221/224; 221/241; 221/259; 221/268; 49/142

[58] Field of Search ..... 221/1, 28, 29, 151, 221/152, 154, 155, 196, 208, 210, 224, 226, 259, 268, 241, 242, 304; 194/233, 248; 49/142

[56] References Cited

U.S. PATENT DOCUMENTS

| | | | |
|---|---|---|---|
| 2,885,051 | 5/1959 | Casey et al. | 221/152 X |
| 4,042,146 | 8/1977 | Nutter | 221/152 |
| 4,085,864 | 4/1978 | Gordon | 221/155 |
| 4,174,047 | 11/1979 | Owens | 221/154 |
| 4,700,869 | 10/1987 | Bogner | 221/241 X |
| 4,981,236 | 1/1991 | Riedle et al. | 221/241 |

FOREIGN PATENT DOCUMENTS

| | | |
|---|---|---|
| 659146A5 | 12/1986 | Switzerland . |
| 2124604 | 2/1984 | United Kingdom . |

*Primary Examiner*—Robert P. Olszewski
*Assistant Examiner*—Dean A. Reichard
*Attorney, Agent, or Firm*—Harold D. Messner

[57] ABSTRACT

The present invention comprises a one-at-a-time dispensing assembly for newspaper racks of tetrahedral shape in which the assembly is positioned within and spans the walls of the rack. The dispensing assembly of the invention includes a fixed support base subassembly fixedly positioned—in a vertical sense—adjacent to the lower edge of the rack opening, and a shaker subassembly. The base subassembly supports both a stack of newspapers and a planar member of the shaker subassembly. The shaker subassembly also includes a lever extending exterior of the rack below the lower edge of the rack opening actionably connected to the planar member. Purpose: to permit to-and-fro movement of the planar member supporting the stack of newspaper via corresponding movement of the lever. In accordance with method aspects, the buyer causes such movement via an exterior lever extending from the rack and as a result of such action, exposes to his view a portion of a single newspaper which occurs before he activates the coin operated latching mechanism. After coins have been inserted and the rack door has been opened, the newspaper previously exposed, can be pulled from the stack. But when the buyer opens the rack door to obtain his newspaper, the lever and hence the shaker subassembly to which it is attached, becomes inoperative. Result: only one newspaper per door opening can be dispensed. But the dispensing assembly of the invention can also be disengaged quickly to permit a distributor to easily reload the rack on a daily basis.

20 Claims, 7 Drawing Sheets

NEWSPAPER RACK WITH IMPROVED ONE-AT-A-TIME DISPENSING ASSEMBLY

SCOPE OF THE INVENTION

This invention relates to a newspaper rack in which the papers are positioned horizontally with respect to the earth's surface interior of a horizontally- or vertically-opening tetrahedral shaped support structure and more particularly to such a rack in which its hinged, partially transparent front door (that includes a conventional coin-operated latch mechanism releasably attaching the door relative to the walls of the rack), is provided with one-at-a-time dispensing assembly by which newspapers are dispensed on a one-newspaper per door opening basis without complicating the resupply procedures of the distributor.

BACKGROUND OF THE INVENTION

Newspaper dispensing racks of which the present invention relates, include lid-opening or door opening structures of tetrahedral cross section that include upright side and back walls. A spring-loaded, transparent front door completes each assembly. It is hinged along a vertical or horizontal pivot axis. Such front doors are releasably attached to the walls of the racks via a coin-operated latch mechanism, and are opened on the following occasions: by the distributor to initially place a stack of newspapers interior thereof for sale; next by the buyer after insertion of a predetermined number of coins into the latch mechanism. Unfortunately to permit the distributor to rapidly place the stack of newspapers interior of the rack per one door opening, also allows a buyer to extract more than one newspaper after purchase has occurred. While various designs have been introduced to limit the buyer to one newspaper per door opening, these structures have been difficult to implement in view of the desire of the distributor to service each rack via a single door opening without expending time to initiate special slotting arrangements or place special insertions between newspapers. Also, such designs require careful maintenance to function in the desired manner on a repeatable basis. In addition, some are too complicated for use by busy purchasers. Furthermore they have been found to be difficult to add to existing racks where the distributor has a substantial supply on hand.

TERMS

"Coin-operated Latch Mechanism" means a mechanism that has a series of slots that accepts and counts a pre-determined number of coins to release a male subassembly attached to the front door of a rack from a female subassembly attached to one of the walls of the rack (usually the top or side wall). Such mechanisms are shown and described in the art.

SUMMARY OF THE INVENTION

The present invention comprises a one-at-a-time dispensing assembly for newspaper racks of tetrahedral shape in which the assembly is positioned within and spans the walls of the rack. The dispensing assembly can be added to either a one- or two-story news rack or be part of new rack design. In any of such designs, the present invention includes a fixed support base subassembly positioned—in a vertical sense—adjacent to the lower edge of the rack opening of the transparent. A shaker subassembly is a second element of the dispensing assembly of the invention and includes a planar member slidably affixed atop the base subassembly supporting a stack of horizontally disposed newspapers within the newspaper rack. The shaker subassembly also includes a lever that must be manipulated by the buyer. Such lever is positioned below the lower edge of the rack opening and has a gripping portion extending exterior of the rack. Its other end is actionably connected to the planar member. Purpose: to translate to-and-fro movement of the lever to corresponding movement of the planar member supporting the stack of newspapers as explained below.

In accordance with method aspects, the buyer is the prime generator of such movement and as a result of such action, the dispensing assembly of the invention exposes to his view a portion of a single newspaper. Such exposure occurs before he activates the coin operated latching mechanism of the rack. The exposed portion of the newspaper appears in full view to the buyer in a location between the dispensing assembly and the transparent front door of the rack. After coins have been inserted in the coin operated latch mechanism and the rack door has been opened, the newspaper previously exposed, can be pulled from the stack. But when the buyer opens the rack door to obtain his newspaper, note that the lever and hence the shaker subassembly becomes inoperative. Result: only one newspaper per door opening can be dispensed. But the dispensing assembly of the invention has further advantages. It can also be disengaged quickly to permit a distributor to easily reload the rack with a supply of papers on a daily basis without need for special preparations of the newspapers comprising the stack or the dispensing assembly itself.

In more detail, the fixed base subassembly of the dispensing assembly of the invention can take many shapes but the preferred construction comprises a framing support of rectangular cross section spanning the rack in a horizontal fashion. The support includes two pairs of cross members interior of a rail-like structure comprising two pairs of peripheral members. The peripheral members are welded together in a rectangular configuration with the cross members before being joined to a separate and distinct planar floor member that includes a pair of L-shaped flaps at opposite sides that accept fasteners to attach the subassembly to the walls of the rack.

In order to permit the planar member of the shaker subassembly to slide relative to the base subassembly, pairs of rollers are positioned between these subassemblies. These rollers are located on broad surfaces of the pairs of cross members spanning across a central aperture of the peripheral members. In plan view, the rollers contact the planar member in locations that provide stable, slidable contact. Since such contact is limited in a friction sense, note that horizontal movement of planar member relative to the base subassembly is rather easy to achieve.

Note that the planar member of the shaker subassembly is constructed of wood and has a smooth lower horizontal surface that contacts the framing support of the base subassembly at the following locations: at front edge of the front peripheral member that is constructed along the three other peripheral members to define a peripheral border region and at point locations coincident with its contact with the rollers supported by the cross members. Such contact is augmented by a pair of springs that attach to the undersurface of the planar member, thence extend through the framing support and finally through the planar floor member of the base subassembly and still further are fixedly connected near the front edge of the latter. As a result, there is provided a down-loading force to the planar member that aids in the one-at-a-time dispensing of the newspapers at its upper surface. Note in this regard that such upper surface is constructed to be gnarled.

As previously mentioned, to-and-fro horizontal movement of the planar member of the shaker subassembly is provided by corresponding movement of a lever slidably positioned through a first opening in the front panel of the rack and thence through a second opening a support bar or beam attached to the side walls of the rack. A bushing can be provided to reduce the friction developed between the lever relative to the openings. The sliding plane of the lever is a horizontal one just below the lower surface of the planar floor member of the base subassembly. As previously stated, the lever also has an exterior grip portion that extends through the front panel of the rack. The exterior grip portion is adapted to be grasped by the buyer so as to provide to-and-fro rectilinear motion to the planar member and to the stack of newspapers supported thereby.

Attachment of the lever to the planar member of the shaker subassembly is as follows. An interior end of the lever is attached to a lower central arm of a T-shaped support. The parallel arms of the support are horizontally positioned in attachment to the lower surface of the planar member along coincident axes of symmetry. The vertical arm is normal to the parallel arms and extends downward through a slot in the floor member of the fixed base subassembly before being attached to the remote end of the lever. The dimensions of the vertical arm and the slot are controlled to provide limited travel of the lever in the horizontal sliding plane, say to about 1 inch of unidirection travel.

Vertically positioned across and partially closing off the front central opening of the rack, is a grille member. It is composed of a series of interconnecting bars of rows and columns. The grille member includes termini attached to the walls of the rack. As a result, the upper ½ or so of such front opening is closed to penetration by a human's hand.

In contrast, the lower ½ of such rack opening is either open or closed to such hand penetration because of the positioning a gate member attached at one side of such rack opening. Such gate member is fitted with a vertically extending tubular hinge that fits about a fixed post vertically extending from the planar floor member of the base subassembly. Such fixed post is positioned at one side of the rack opening. At the other side of the opening of the rack door is a second fixed post having a lower end attached to the planar floor member and an upper end attached to the grille member. The second fixed post is also fitted with a hoop adjacent to its upper end. When the gate member is swung closed, the hoop extends through a slot in the gate member so that when a conventional lock is attached through the hoop, movement of the gate member from a closed to a open position, is prevented.

The vertical position of the gate member relative to the grille member is variable so to permit one-at-a-time dispensing of the deepest newspaper supported on the planar member of the shaker subassembly. That is, the height of the gate member relative to the planar member of the shaker subassembly can be changed in orderly fashion dependent upon the thickness of the newspaper to be dispensed. In that way, there is provided—in the closed position of the gate member—a slot between the lower edge of the gate member and the horizontal projection of the upper surface of planar member of the shaker subassembly. The slot dimensions are such to permit only a single newspaper can be dispensed.

To vary the height of the gate member, a peg bar latching subassembly is provided. It includes a rectangularly shaped main peg bar cantelevered from the grille member. The main peg bar includes first and second broad surfaces, the former facing the grille member and including a pair of studs extending therefrom and attaching to a pair of openings in the grille member. The second surface faces outward toward the front door opening of the rack. A series of parallel openings communicate the first surface with the second surface into which an auxiliary movable annotated peg bar also of rectangular shape is positioned. Since the auxiliary bar is provided with only a pair of prongs, only a like number of such openings in the main support bar are used during a single daily operation of the invention. This is because thick newspapers require selection of a pair of openings in the main peg bar closest to the grille member. Thinner newspapers require use of openings closer to the shaker subassembly. The prongs of the auxiliary peg bar extend in cantelever style from the second surface of the main peg bar toward the rack opening. The amount of such extention is controlled so that the prong ends penetrate through a horizontal slotted bar in an upper edge of the gate member when the latter is placed in closed position relative to the door opening of the rack. In such position, the gate member is thereby affixed relative to the grille in its closed, locked position in a manner that provides a correctly sized slot at the lower edge of the gate member above the movable planar member of the shaker subassembly. In that way, a single newspaper can be dispensed through such slot by to-and-fro movement of the bar and planar member of the shaker subassembly.

In accordance with method aspects, the distributor opens the rack and ones inside the rack opens the gate member of the dispensing assembly of the invention. He next loads the rack with a stack of newspapers with central fold lines of the pages facing outward toward the central opening of the rack and places a weighted bar on the upper newspaper of the stack wherein the weight of the bar acts adjacent to the foldlines of the newspaper, i.e., the center of gravity of the bar is closely adjacent to the stacked foldlines of the newspaper that face outward toward the door opening of the rack. He then sets the gate latch subassembly to provide a correctly sized slot opening to dispense one newspaper at a time. That is, he first removes the main and auxiliary peg bars from the grille member, relocates the auxiliary peg bar relative to the main peg bar to new locations whereby the pair of prongs of the auxiliary peg bar extend through the correct annotated pair of openings in the main peg bar that corresponds to the thickness of newspaper to be dispensed. Then he reattaches the combination of the main and auxiliary peg bars to the grille member and swings the gate member shut into contact with prongs of the auxiliary peg bar. Note that the deepest newspaper is then horizontally and vertically aligned with the correctly sized slot between the lower edge of the gate member and the planar member of the shaker subassembly. After a conventional lock is added to secure the gate member relative to the rack, the rack door is closed. The coin-operating latch is then activated.

The buyer initiates the purchase procedure by providing to-and-fro movement of the lever. Although unidirectional travel is slight, about one inch, dispensing of one newspaper per door opening occurs. In more detail, as the buyer brings the lever toward the closed transparent door of the rack, the deepest newspaper along with the newspaper stack itself, are carried toward the slot. In this regard, the gnarled surface of the planar member contact the plurality of page edges of the deepest newspaper. As the lever abruptly contacts a side of a slot in the planar floor member of the base subassembly, momentum carries the deepest newspaper into the slot while neighboring newspapers make contact with the broad inner surface of the gate member. Since the lower edge of the gate member is constructed to provide curvature of the portion of the deepest newspaper positioned within the slot, some wedging contact occurs. Such contact results in the relative coefficients of friction between the deepest newspaper and the planar member of the shaker subassembly changing. As a result, as the buyer moves the lever away from the door of the rack, the friction forces acting between the planar member and the deepest newspaper becomes less than that acting on the deepest newspaper itself even though initially, the reverse is true (i.e., the coefficient of friction of the gnarled surface of the planar member is initially greater than that between the surfaces of the deepest newspaper and it adjacent neighbor). As a result, the planar member is displaced rearward of the rack by the corresponding movement of the lever but without corresponding movement of the deepest newspaper. Then as the buyer repeats movement of the lever toward the door of the rack, the gnarled surface of the planar member digs into the page edges of the deepest newspaper and the latter is again carried toward and deeper into the slot. The process is then repeated until enough of a portion of the deepest newspaper extends beyond the slot (viewable between the shaker subassembly and the door of the rack) to support grippage by the buyer. I.e., there is sufficient paper protruding beyond the slot for the buyer to grip same and extract it if the door of the rack were opened. Then the buyer inserts the correct number and amount of coin(s) to the conventional coin-operated latching mechanism of the rack, releases and then opens the door of the rack and extracts the deepest newspaper. With the opening of the door, a locking mechanism of the shaker subassembly is activated so that the lever is then immovable so no additional papers can be extracted.

It is believed the ability of the to and fro movement of the lever to provide uni-directional movement of the deepest newspaper results from, at least in part, the wedging contact of a edge portion of the deepest newspaper between the planar member of the shaker subassembly and the lower edge of the gate member. Hence such "fro" movement does not appreciably carry the stack of newspapers including the deepest paper away from the slot as corresponding movement of the planar member occurs. Then as the buyer repeats movement of the lever toward the door of the rack, the deepest newspaper is again carried toward and deeper into the slot.

DETAILED DESCRIPTION OF THE INVENTION

Figure 1:
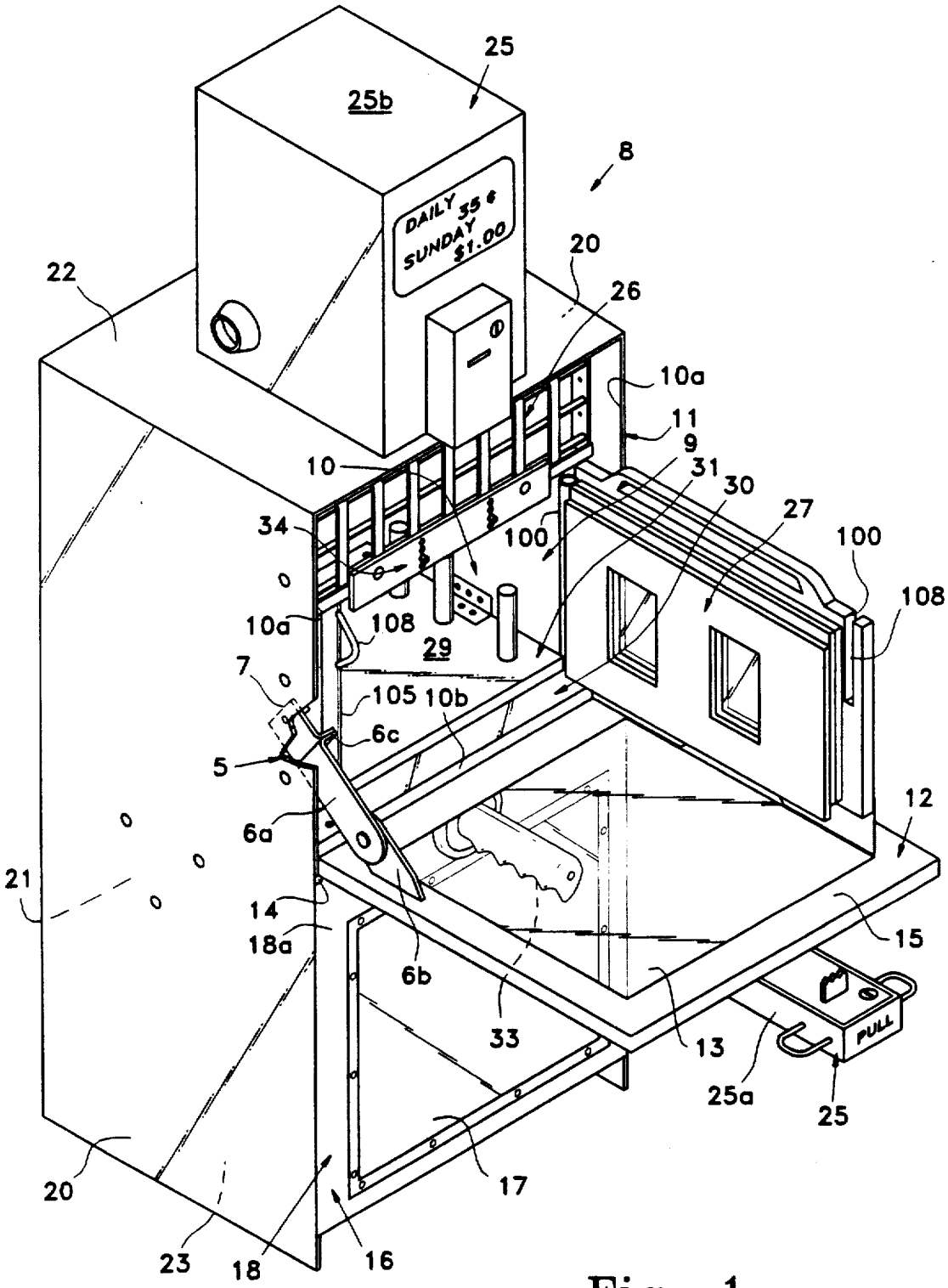
FIG. 1 is a perspective view, partially cut-away, of a conventional newspaper rack illustrating use of the dispensing assembly of the invention wherein the front door of the conventional newspaper rack as well as a gate member of the dispensing assembly are shown in open positions to permit the distributor to place a stack of newspapers interior of the rack as well as change gate height through use of a peg bar latching subassembly attached to a grille member affixed to the news rack.
Figure 2:
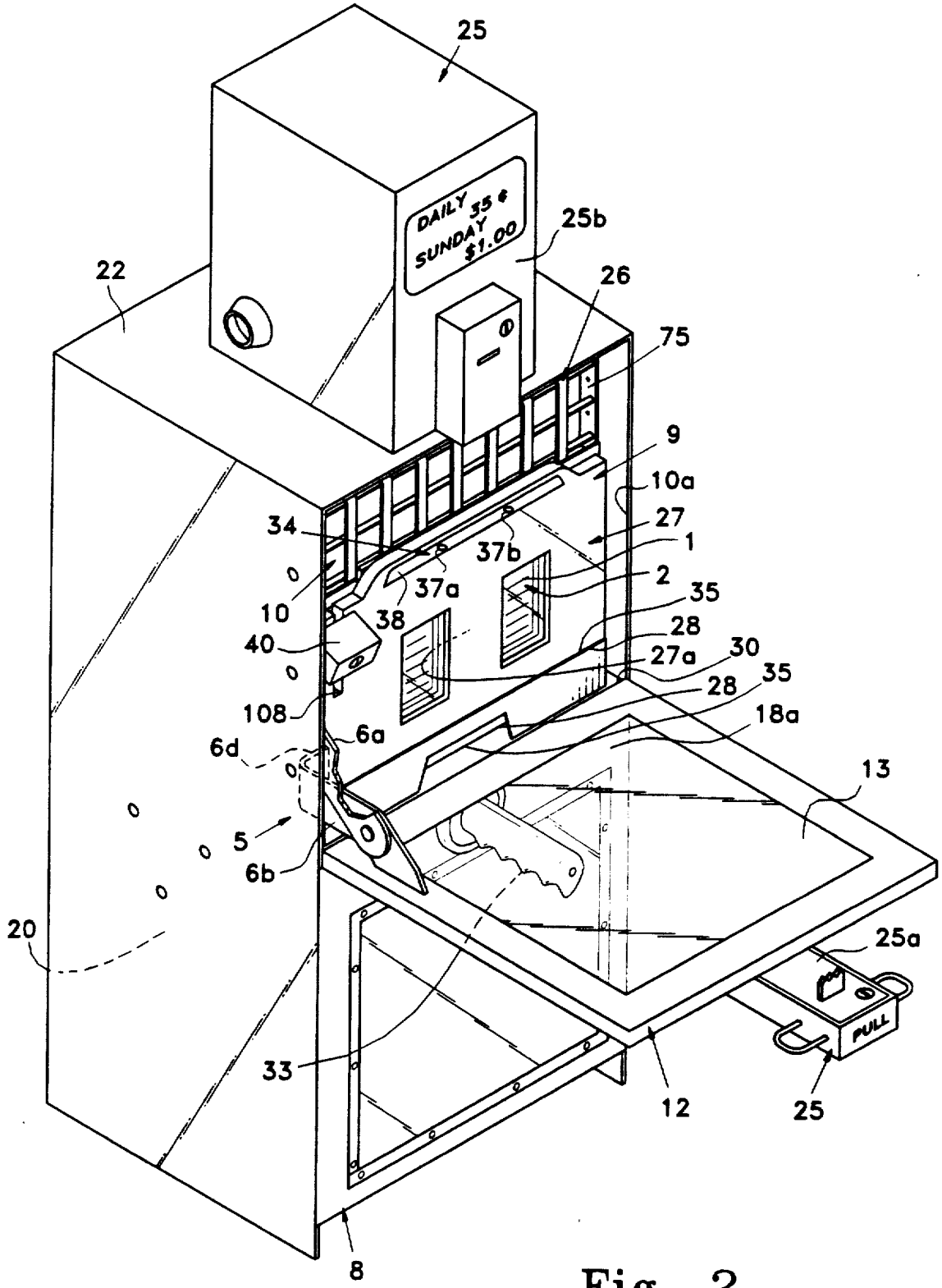
FIG. 2 is another perspective of the newspaper rack of FIG. 1 also partially cut-away, in which the gate member of the dispensing assembly has been swung shut into a closed position and locked wherein the closed gate member and the grille member completely close off the front opening of the news rack to penetration by a human's hand(s) except for an elongated slot between a planar member of a shaker subassembly and a lower edge of the gate member but where a lever of the dispensing assembly to provide to-and-fro movement of the shaker subassembly is shown.

FIG. 1 is a perspective view of a conventional newspaper rack 8 fitted with the dispensing assembly 9 of the invention interior of a central cavity generally indicated at 10. The rack 8 is of a two-story configuration and includes a front side generally indicated at 11. The top story of the front side 11 comprises a door 12 fitted with transparent wall 13, a spring-loaded hinge 14 and a rim segment 15. When the door 12 is opened as shown in FIGS. 1 and 2, note that cavity 10 includes an open entrance or end indicated at 10*a* which can be closed off when the door 12 is swung closed.

In addition to the door 12, the front side 11 of the rack 8 also includes a first-story panel 16. The first-story panel 16 includes a transparent wall 17 interior of a border segment 18 that includes an upper segment 18*a* positioned just below the spring-loaded door hinge 14 of the door 12.

The construction of the rack 8 is completed by elongated side walls 20, rear wall 21, top wall 22 and bottom wall 23. These walls 20-23 extend across both of the two-stories of the front side 11 and attach together to define the central cavity 10 previously mentioned.

Attached between the rim segment 15 and the top wall 22 is a conventional coin-operated latching mechanism generally indicated at 25. Such mechanism 25 includes a male subassembly 25*a* attached to the rim segment 15 of the door 12 and a female subassembly 25*b* positioned atop top wall 22. The mechanism 25 is conventional in the art and operates as follows: when activated the male subassembly 25*a* delatches from the female subassembly 25*b* and permits the door 12 to be positioned in open position, as shown in FIGS. 1 and 2.

While prior racks 8 of which I am aware have been constructed such that—with the door 12 open—the open end 10*a* of the cavity 10 that was usually clear of obstructions, the present invention closes off such open end 10*a* using a grille member 26 and a hinged gate member 27 in the manner described in more detail below.

Figure 3:
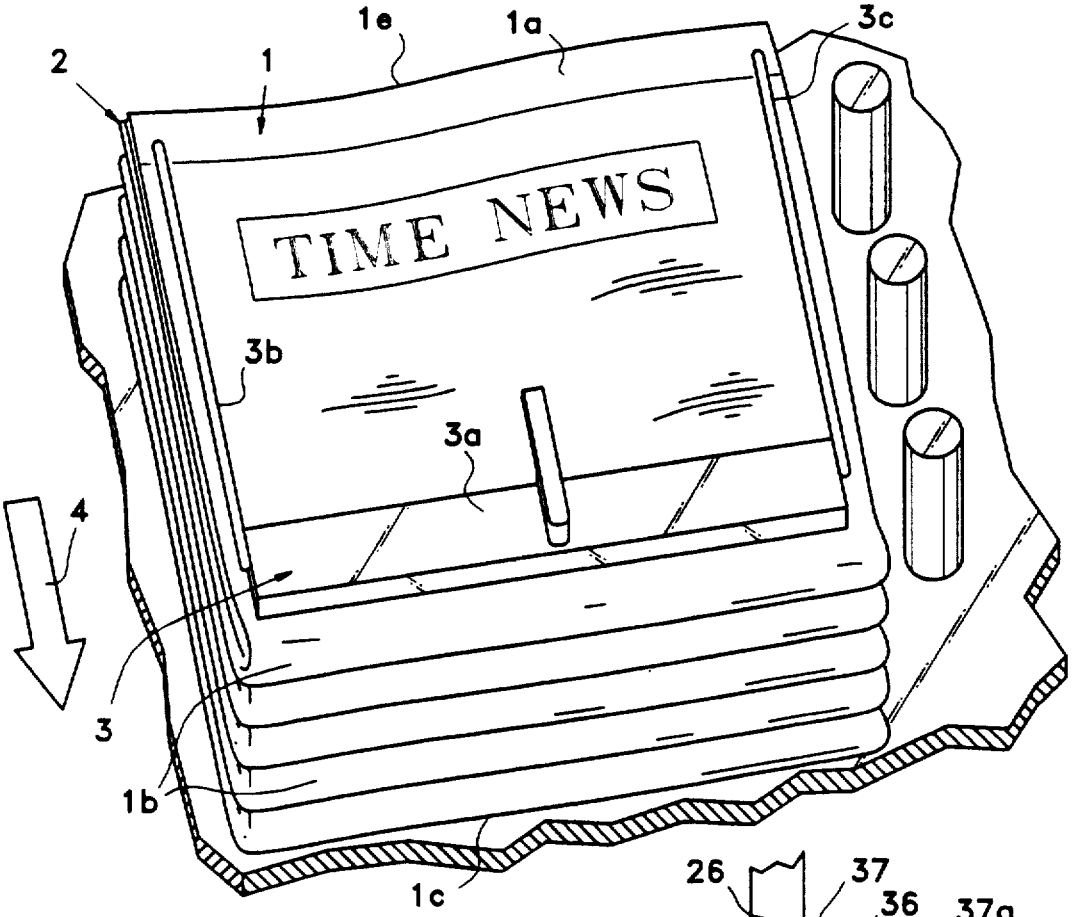
FIG. 3 is a detail plan view of a horizontal stack of newspapers interior of the rack of FIGS. 1 and 2 illustrating the placement of a weighted bar atop the stack to sharpen the central foldlines of the stack and ease movement of individual newspaper through the elongated slot of FIG. 2.

The dispensing assembly 9 of the present invention permits one-at-a-time dispensing of newspapers 1 shown in FIG. 2 within the rack 8. Such newspapers 1 are horizontally positioned in a stack 2 within the central cavity 10 of the rack 8. As explained in detail below; the present invention permits ejection of a single newspaper 1 through elongated slot 28 between gate member 27 and fixed base subassembly 30. Playing a role in the ejection process is the positioning of the newspapers 1 of the stack 2 within the rack 8. As shown in FIG. 3, the newspapers 1 are positioned in a vertically extending column comprising the horizontal stack 2 in a particular configuration. Note that a weighted U-shaped bar 3 is positioned atop the top-most newspaper 1*a* of the stack 2. The bar 3 has a centroid in close vertical alignment with center foldlines 1*b* of the newspapers 1 to sharpen such foldlines 1*b*. In that way, the silhouette of the lowest newspaper 1*c* of the stack 2 is low and is able to travel in the direction of arrow 4 with the foldlines 1*b* at the leading edge of such travel.

Returning to FIG. 1, note that the dispensing assembly 9 includes the fixed base subassembly 30 previously indicated that is fixedly positioned relative to the walls 20, 21 of the rack 8. Such position—in a vertical sense—is horizontally adjacent to below lower edge 10*b* of the opening 10*a* of the rack 8.

A shaker subassembly generally indicated at 31 completes the dispensing assembly 9. Briefly, such subassembly 31 includes a planar member 29. The planar member 29 is slidably attached to and positioned above the base subassembly 30.

The shaker subassembly 31 also includes a lever 33 extending through the upper segment 18*a* of the front panel 16 below the lower edge 10*b* of the rack opening 10*a*. Purpose: to permit to-and-fro movement of the lever 33 which translates into corresponding motion of the planar member 29 of the shaker subassembly 31. Such movement is relative to the base subassembly 30. That is, with movement of the lever 33 there is corresponding movement of the planar member 29 in the manner explained below.

In accordance with method aspects of the invention, the distributor opens the door 12 of the rack 8 to the position shown in FIG. 2 and activates a locking latch 5 at one side of the opening 10*a* of the rack cavity 10 to keep door 12 open. Such locking latch 5 is shown in detail in FIG. 1 and includes a pawl 6*a* pivotally attached to an arcuate-shaped guide bar 6*b*. Such attachment is near mid-region of guide bar 6*b* so that the pawl 6*a* can be rotated from the guide bar 6*b* by the distributor so as to place flared end 6*c* into contact with stop 7 attached to the side wall 20 of the rack 8. In such position, such pawl 6*a* and stop 7 overcome the force provided by the spring-loaded door hinge 14 and keeps the door 12 in an open position as shown in FIGS. 1 and 2. Once the door 12 is opened, the distributor swings gate member 27 to the position also shown in FIG. 1. He next loads the rack 8 with the stack 2 of newspapers 1 in the configuration shown in FIG. 3 such that central foldlines 1*b* face outward toward of the central door opening 10*a* (FIG. 1), and places the U-shaped weighted bar 3 on the upper-most newspaper 1*a* of the stack 2.

Still referring to FIG. 3, the weight of the bar 3 acts through a centroid vertically acting adjacent to and through the foldlines 1*b* of the individual newspapers 1, i.e., the center of gravity of the bar 3 is due mainly to its base 3*a* of rectangular cross section being positioned closely adjacent to the foldlines 1*b* of the newspapers 1. To maintain stability, the bar 3 includes two smaller spaced apart guidearms 3*b* and 3*c* that radiate from the base 3*a* closely adjacent to the sides of the stack 2 of newspapers 1. The distributor then sets a correct gate height for the gate member 27 using a gate latch subassembly generally indicated at 34 in FIGS. 1 and 2.

Figure 5:
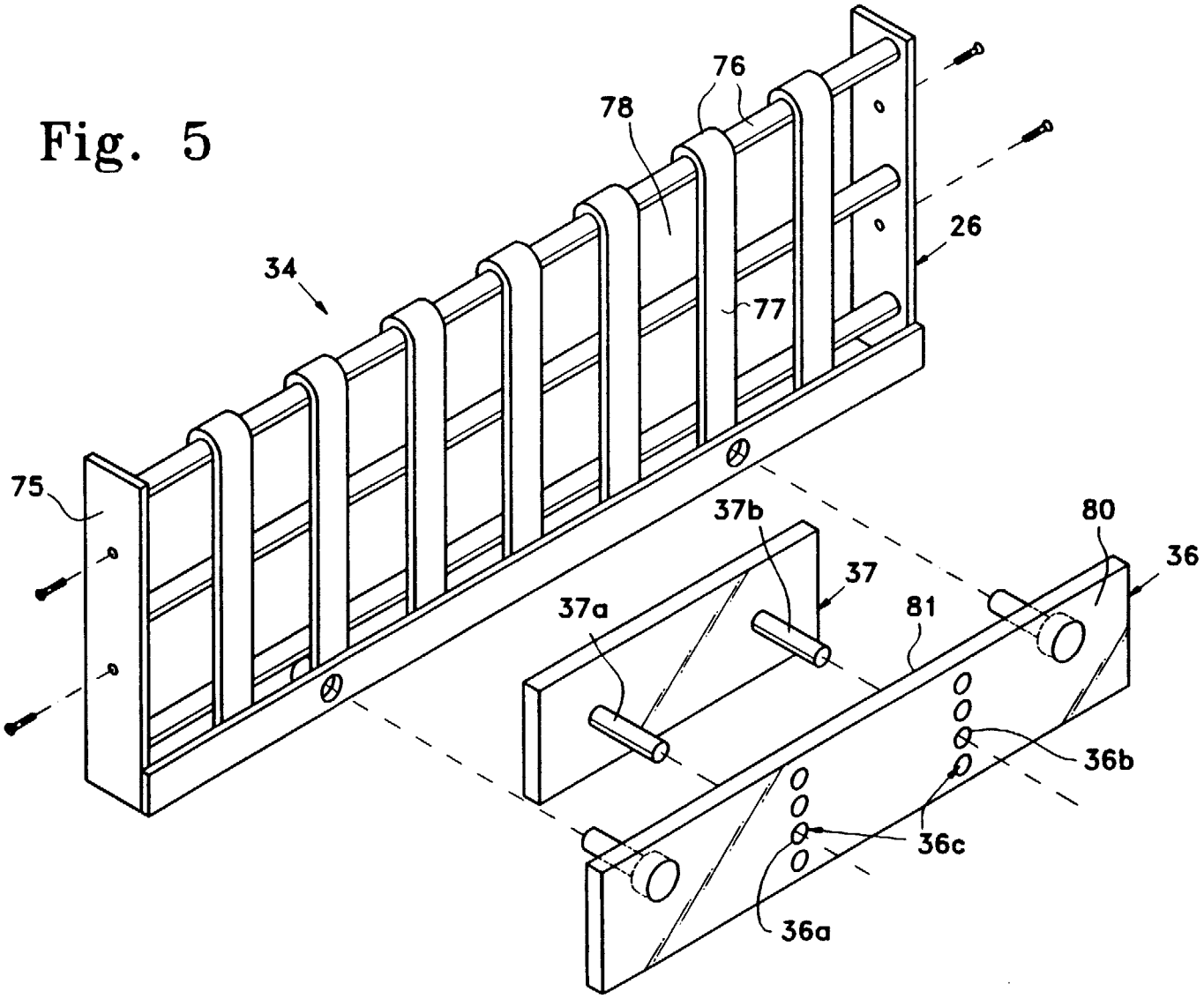
FIG. 5 is an exploded view of the peg bar latching subassembly of FIGS. 1 and 4 useful in varying the gate height of the gate member relative to the planar member of the shaker subassembly.

FIG. 5 illustrates the gate latch subassembly 34 in more detail.

Its purpose: to provide the correctly sized, elongated slot 28 (see FIG. 2) to dispense one newspaper at a time at lower edge 35 of the gate member 27. Still referring to FIG. 5, the distributor first removes the main and auxiliary peg bars 36, 37 from the grille member 26, relocates the auxiliary peg bar 37 relative to the main peg bar 36 to new locations thereby the pair of prongs 37*a*, 37*b* of the auxiliary peg bar 37 extend through the correct annotated pair of openings 36*a*, 36*b* of a series of openings 36*c* in the main peg bar 36 that corresponds to the thickness of newspaper to be dispensed. Then he re-attaches the combination of the main and auxiliary peg bars 36, 37 to the grille member 26 and thereby establishes the correct gate height for the invention. Note in FIG. 2 in such closed position, the prongs 37*a*, 37*b* have sufficient length so as to also extend through slot 38 of the gate member 27 to establish the correct height of the gate member 27. Be aware from FIG. 2 that the deepest newspaper of the stack 2 is then in alignment with the slot 28 as explained below. Thereafter, a conventional lock 40 is added to secure the gate member 27, the rack door 12 is next closed and the coin-operating latch mechanism 25 is then activated.

Thereafter, the buyer initiates the purchase procedure by providing to-and-fro movement of the lever 33. Although total unidirectional travel is slight, about one inch, dispensing of one newspaper per door opening occurs. In more detail, as the buyer initially brings the lever 33 toward the closed transparent door 12, the deepest of the newspapers 1 (along with the rest of the stack 2), are carried toward the gate member 27 in horizontal alignment with elongated slot 28. As the lever 33 abruptly stops as explained below, momentum carries the deepest of the newspapers 1 into the slot 28 while neighboring newspapers make contact with broad inner surface 27*a* of the gate member 27. Then as the buyer reloads the lever 33 away from the gate member 27, the process is then repeated until enough of a portion of the deepest of the newspapers extends beyond the slot 28 (viewable between the shaker subassembly 31 and the door 12 of the rack 10 in FIG. 1) to support grippage by the buyer. I.e., there is sufficient paper protruding beyond the slot 28 for the buyer to grip same and extract it if the door 12 of the rack 10 were opened. Then the buyer inserts the correct number and amount of coin(s) to the conventional coin-operated latching mechanism 25. The male subassembly 25*a* delatches from the female subassembly 25*b*, unlocking the door 12 and permits the buyer to swing the door 12 open at which time he extracts the deepest of the newspapers 1. With the opening of the door 12, a locking mechanism (not shown) of the shaker subassembly 31 is activated so that the lever 33 is then immovable so no additional papers can be extracted. Such locking mechanism is described at number 120 in FIGS. 7-9 below.

Figure 4:
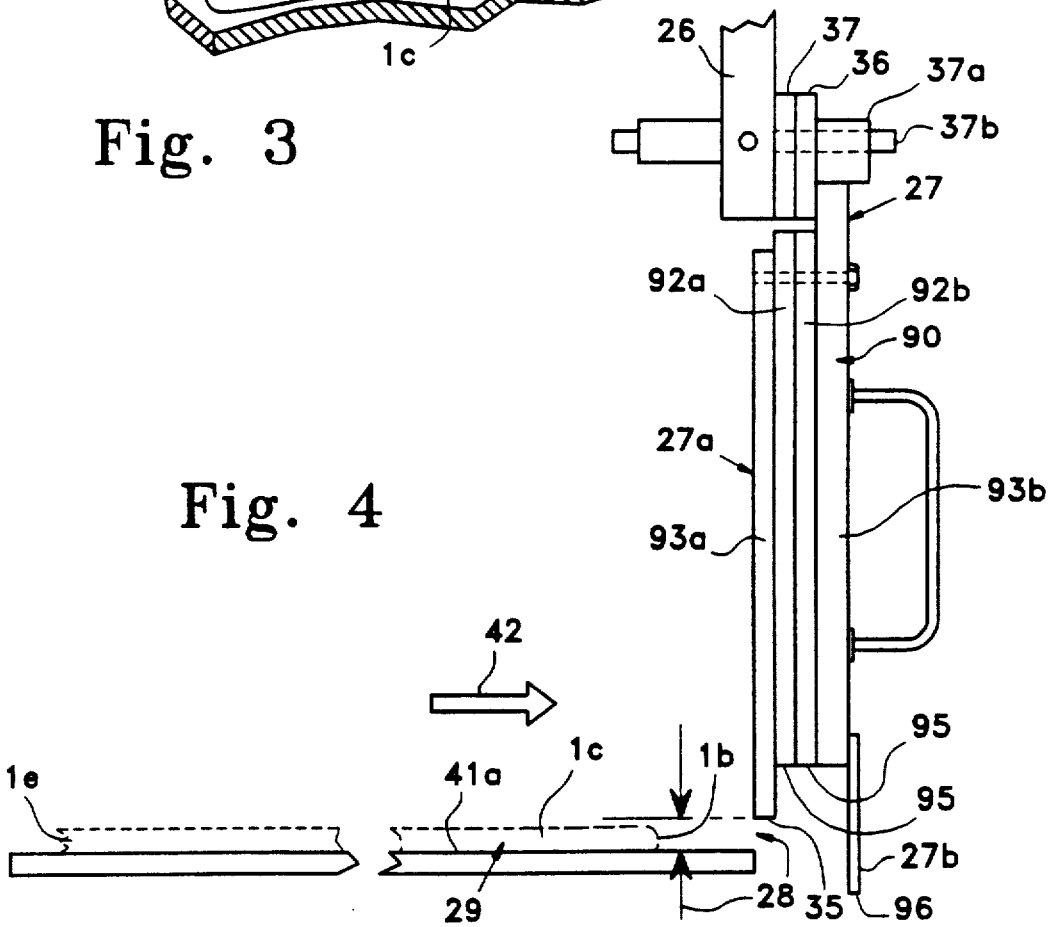
FIG. 4 is a side view, partially schematic, of the gate member of the rack in a closed position relative to planar member of the shaker subassembly, the grille member and the peg bar latching subassembly.
Figure 6:
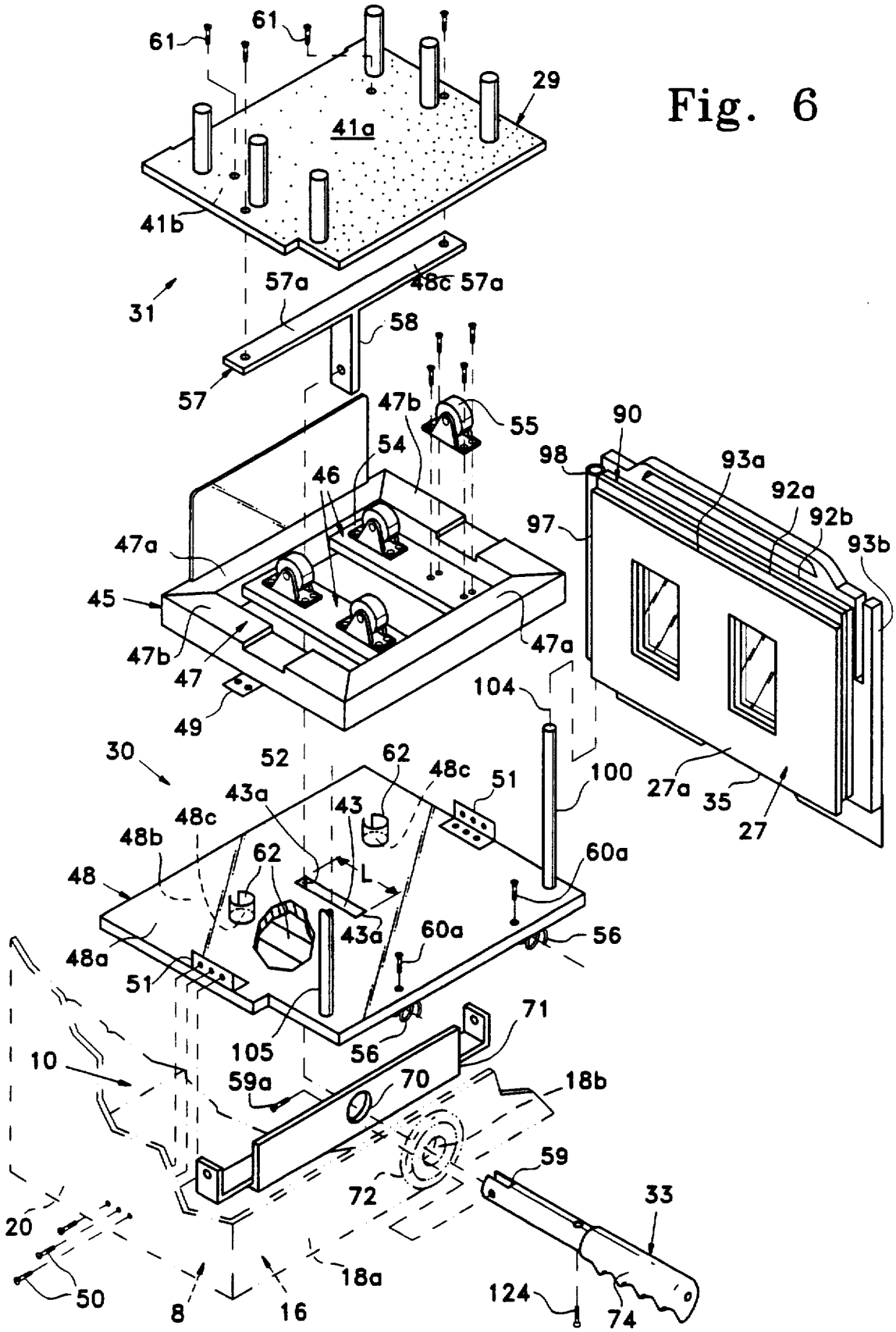
FIG. 6 is an exploded view of the dispensing assembly of the invention in which mode of attachment of the gate member of FIGS. 1 and 2 is shown in detail with respect to base and shaker subassemblies of the invention but wherein the grille member and the peg bar latching subassembly of FIGS. 1 and 2 as well as a locking mechanism of the shaker subassembly have been omitted.

FIG. 4 shows the relationship of the elongated slot 28 as measured between lower edge 35 of the gate member 27 and the horizontal projection of upper surface 41*a* of the planar member 29. Note in this regard, the construction of the planar member 29 aids in carrying out the object of the present invention. As shown in FIG. 6, the upper surface 41*a* is constructed with a gnarled, uneven shape which provide a significant coefficient of friction. Returning to FIG. 4, the deepest newspaper 1*c* is easily expelled via the slot 28. Note that the multiple edges 1*e* of the deepest newspaper 1*c* (opposite to foldlines 1*b*) are brought into contact with the gnarls of the surface 41*a* which contributes to forward movement of the deepest newspaper 1*c* in the direction of arrow 42 toward and into the elongated slot 28.

The gate member 27 is also constructed to provide curvature to the deepest newspaper 1*c* as travel through the slot 28 occurs since flap 27*b* forward of the edge 35 has a deeper horizontal projection than edge 35. As a result, some wedging contact occurs. Such contact results in the relative coefficients of friction between the deepest newspaper 1*c* and the planar member 29 changing. As a result, as the buyer moves the planar member 29 away from the gate member 27, the friction forces acting between the planar member 29 and the deepest newspaper 1*c* becomes less than that acting on the deepest newspaper 1*c* itself even though initially, the reverse is true (i.e., the coefficient of friction of the gnarled surface 41*a* of the planar member 29 is initially greater than that between the surfaces of the deepest newspaper 1*c* and its adjacent neighbor). As a result, the planar member 29 is displaced rearward from the gate member 27 but without corresponding rearward movement of the deepest newspaper 1*c*. Then as the buyer repeats forward movement of the planar member 29 toward the gate member 27, the gnarled surface 41*a* of the planar member 29 digs into the page edges 1*e* of the deepest newspaper 1*c* and the latter is again carried toward and deeper into the slot 28.

In operations with further reference to FIGS. 1 and 2, as the lever 33 abruptly stops as explained below through contact with a slot 43 (see FIG. 6) of the base subassembly 30, momentum carries the deepest newspaper 1*c* of FIG. 4 into the slot 28 while neighboring newspapers make contact with broad inner surface 27*a* of the gate member 27.

FIG. 6 shows the dispensing assembly 9 of the invention in more detail.

As shown, the fixed base subassembly 30 includes a framing support 45 comprosed of a series of cross bars 46 and peripheral bar members 47 wherein the latter are welded together into a rectangularly shaped framing configuration before the cross bars 46 are joined. Then the combination is attached to a planar floor member 48 via attachment of ears 49 of peripheral members 47 to L-shaped flaps 51 attached to the floor member 48. The flaps 51 in turn are affixed to the walls 20 of the rack 8 by fasteners 50.

The peripheral members 47 are L-shaped in cross section and include front and rear pair 47*a* positioned normal to a side pair 47*b*. The ends of legs of the pairs 47*a*, 47*b* are cut along a 45 degree bias and then joined, by welding, wherein the 45 degree bias defines imaginary projections that intersect at vertical axis of symmetry 52 of the base subassembly 30.

Cross members 46 extend parallel to the side pair 47*b* of peripheral members 47 to provide support of a series of rollers 55, say four in number attached to broad surfaces 54 of the cross members 46. The rollers 55 are positioned below and are in contact with undersurface 41*b* of the planar member 29 of the shaker subassembly 31. Since such contact is limited in a friction sense, note that horizontal movement of planar member 29 relative to the framing support 45 of the base subassembly 30 is rather easy to achieve.

Besides the planar member 29, note that the shaker subassembly 31 also includes a T-shaped support 57 comprising arms 57*a* that attach to the smooth undersurface 41*b* of the planar member 29 and a vertical arm 58 of rectangular cross section that extends downward from the parallel arms 57*a*. The vertical arm 58 extends through slot 43 in the floor member 48 for attachment to slotted end 59 of the lever 33 via fastener 59*a*. Note that the length L of the slot 43 vis-a-vis the width of the vertical arm 58 of the T-shaped support 57 is engineered so as have movement of only one inch or so before the arm 58 intercepts an end 43*a* of the slot 43.

The planar member 29 is of a wood construction and its smooth undersurface 41*b* that contacts the base subassembly 25 at the following locations: at point intersections with the rollers 55. Such contact is augmented by a pair of springs 56 that attach by fasteners 60*a* to undersurface 48*b* of the floor member 48, then extend through openings 48*c* in the floor member 48, thence through framing support 45 between the cross members 46 and the peripheral members 47 and finally attach to undersurface 41*b* of the planar member 29 via fasteners 61. As a result there is provided a down-loading force to the planar member 29. Note that such position of the planar member 29 completely closes off any openings within the framing support 45. For the purpose of preventing tangling of the coils of the springs 56, arucate guideways 62 of semi-circular cross section are provided at the undersurface 48*b* of the floor member 48. The guideways 62 are seen to extend above upper surface 48*a* of the floor member 48.

To-and-fro horizontal movement of the planar member 29 is provided by the operation of the lever 33 in the manner previously mentioned. The lever 33 is initially positioned through an opening 18*b* of the border segment 18 of the front panel 16 of the rack 10 and thence through a second opening 70 in a support bar 71 attached to the side walls 20 of the rack 8. A bushing 72 aids in the positioning of the lever 33 relative to the openings 18*b*, 70 and allows the lever 33 to slide within the openings 18*b*, 70. The sliding plane of the lever 33 is in a plane that is horizontally below the undersurface 48*b* of the planar floor member 48. As previously mentioned, the slotted end 59 of the lever 33 captures the vertical leg 58 of the T-shaped support 57 and attachment occurs via fastener 59*a*. The lever 33 also has a grip 74 exterior of the front panel 16 of the rack 8. The grip 74 is adapted to be grasped by the buyer so as to provide to-and-fro rectilinear motion to the planar member 29 and to the stack of newspapers supported thereby as previously mentioned. However, the buyer's hand is always prevented from penetration fully within the cavity 10 of the rack 8 as previously mentioned.

FIG. 5 illustrates grille member 26 in more detail.

Grille member 26 is composed of a series of interlocked bars generally indicated at 76 formed in columns and rows that meet at intersection points 77, such intersection points defining rectangular openings 78 small enough to partially close off the front opening 10*a* (see FIG. 2) of the rack 8. Note in FIG. 2 that the grille member 26 includes termini bars 75 attached to the side walls 20 of the rack 8. As a result, the upper ½ or so of such front opening 10*a* of the cavity 10 is closed to penetration by a human's hand. As previously mentioned with respect to FIG. 5, attached to the grille member 26 are the main and auxiliary peg bars 36, 37 previously mentioned. The main peg bar 36 is rectangularly shaped and includes several columns of openings 36*c*, pairs of which (two being indicated at 36*a*, 36*b*) that are used by prongs 37*a*, 37*b* of the auxiliary peg bar 37 to penetrate through and extend beyond first broad surface 80 of the main peg bar 36 for attachment to the gate member 27 (see FIG. 2). An opposed broad surface 81 attach to the auxiliary peg bar 37.

As previously mentioned, the gate latch subassembly 34 of FIG. 5 is used to set the correct gate height for the gate member 27 as described with respect to FIG. 4. Its purpose: to provide the correctly sized slot 28 to dispense one newspaper at a time between the lower edge 35 of the gate member 27 and the horizontal projection of gnarled surface 41*a* of the planar member 29. In this regard, the positions of the main and auxiliary peg bars 36, 37 can be relocated relative to each after they have been detached from the grille member 26. Such relocation places the pair of prongs 37*a*, 37*b* of the auxiliary peg bar 37 in position to extend through the main peg bar 36 that corresponds to the thickness of newspaper to be dispensed.

As shown in FIGS. 4 and 6, the gate member 27 is rectangularly shaped. Besides lower edge 35 and broad inner surface 27*a*, the gate member 27 includes a wall 90 formed of inner elements 92*a*, 92*b* in broad surface contact with outer elements 93*a*, 93*b*. Lower edges 95 of the inner element 92*a*, 92*b* are offset upwardly with respect to lower edge 35 of the outer element 93*a*. However, lower edge 96 of the flap 27*b* attached to the outer element 93*b* extends below the lower edges 95 and 35. The purpose of the positions of the lower edge 35 and flap 27*b* have been previously mentioned. Returning to FIG. 6 note at side edge 97 of the gate member 27 is tubular hinge member 98. It is constructed to fit about a fixed post 100 attached vertically to upper surface 48*a* of planar floor member 48. Above the fixed post 100, its axis of symmetry 104 is free of obstruction so that the hinge member 98 can be completely displaced from the fixed post 100 in case of repair and the like as required.

A second fixed post 105 is positioned in attaching contact with upper surface 48*a* of the planar floor member 48. It is parallel to the first post 100 and is offset therefrom by a distance that is less than the width of the gate member 27. As a consequence, the second post 105 acts as a stop as the gate member 27 pivots about fixed post 100 to place the gate member 27 in the closed position of FIG. 2.

Referring to FIGS. 1 and 2 note that the second post 105 is also fitted with a hoop 108 that extends through a slot 108 in the gate member 27 when the latter is swung to a closed position. The conventional lock 40 of FIG. 2 is inserted through the hoop 108 for security purposes.

Figure 7:
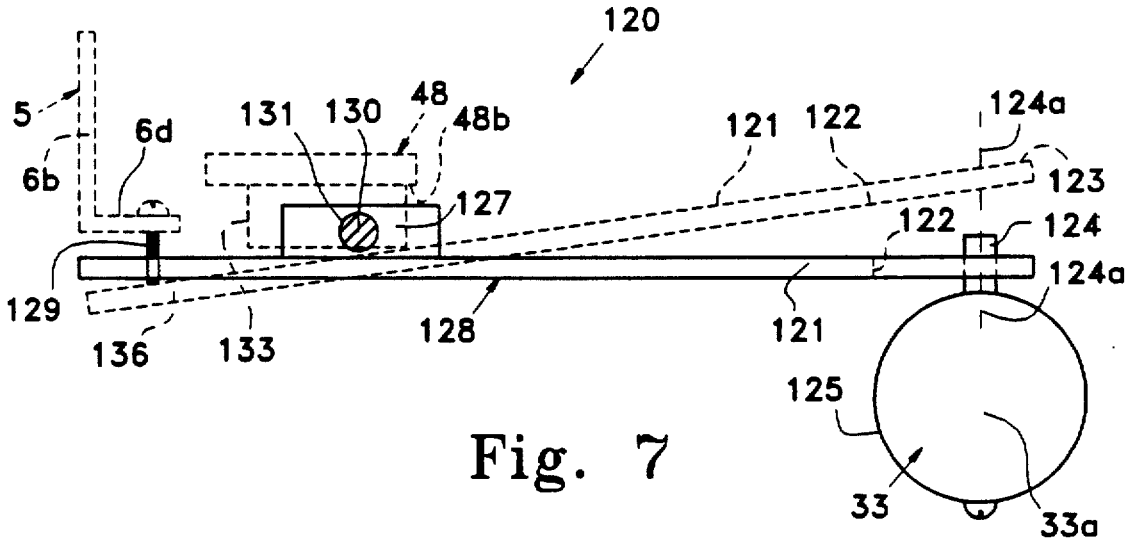
FIG. 7 is a detail front view, partially schematic, of the locking mechanism of the shaker subassembly wherein the lever of FIGS. 1 and 2 can be latched to the base subassembly when the door of the rack, such delatching and latching of the lever being a function of the position of an extension screw or stud that is attached to a conventional locking latch for the door of the rack shown in detail in FIGS. 1 and 2.
Figure 8:
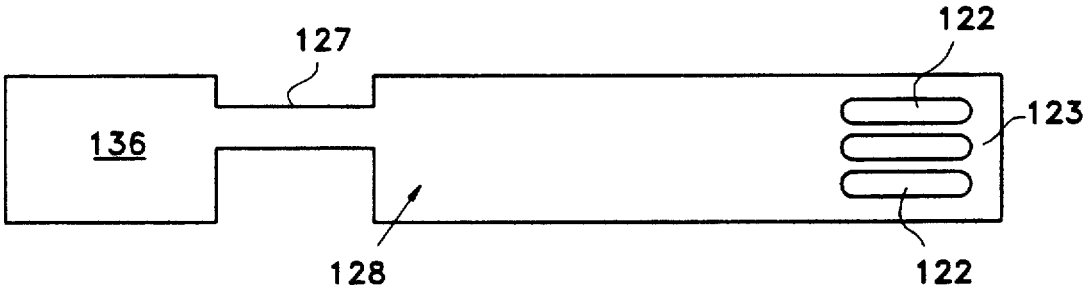
FIG. 8 is a detailed, plan view of the guide bar of the locking mechanism of FIG. 7.
Figure 9:
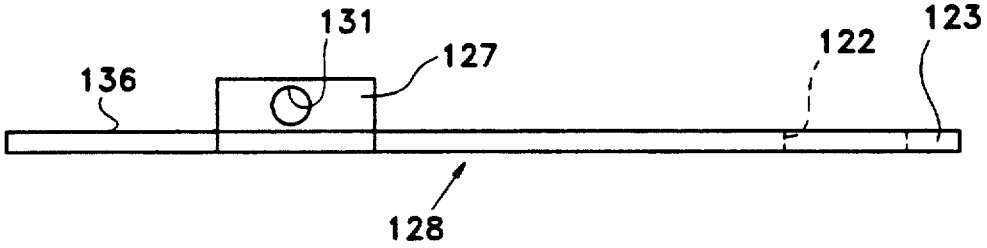
FIG. 9 is a detailed, side view of the guide bar of FIG. 8.

It should be recalled in connection with FIGS. 1 and 2 that when the door 12 of the rack 8 is opened, a locking mechanism 120 of FIGS. 7-9 is activated. Such locking mechanism 120 will now be described.

As shown, the locking mechanism 120 includes pivot bar 121 having a series of slots 122 at a far end 123 into one of which a extension bolt or stud 124 can be disconnectably connected. Such stud 124 has an axis of symmetry 124*a* that is normal to axis of symmetry 33*a* of the lever 33. It radially extends through wall 125 of lever 33. In operation, the pivot bar 121 is provided with see-saw type movement by welding a L-shaped bracket 127 at its mid-region 128 and attaching a fastener 130 through opening 131 in the bracket 127 and thence through a bracket 133 attached to the undersurface 48*b* of the floor member 48.

In operation, when the door 12 of the rack 8 of FIG. 2 is open, the door 12 is positioned such that base 6*d* of the guide bar 6*b* of the locking latch 5 is pivoted upward. As a result, in FIG. 7 the pivot bar 121 is horizontally positioned as shown in solid line. As a result, the weight of the far end 123 is such that the bar 121 is horizontally positioned as shown and the stud 124 of the lever 33 is inserted within and extends through one of the slots 122 in the pivot bar 121. As a result, the lever 33 is immobile. But when locking latch 5 assumes the position shown in phantom line in FIG. 7 (because the door 12 of FIGS. 1 and 2 is closed) the pivot bar 121 is positioned as shown in phantom line wherein the end 123 is above the extension stud 124 of the lever 33 and the lever 33 is free to undergo rectilinear movement. In such position, extension bolt or stud 129 attached to the base 6*d* of the guide arm 6*b* of the locking latch 5 contacts end 136 of the pivot bar 121 and causes see-saw rotation about fastener 130. Note that the stud 124 of the lever 33 is released from one of the slots 122. Hence the lever 33 is free to movement in the manner previously described. That is, the force applied by extension bolt or stud 129 to the pivot bar 121 conditions the pivot bar 121 to make unlocking, releasing contact with the stud 124 of the lever 33.

Figure 10:
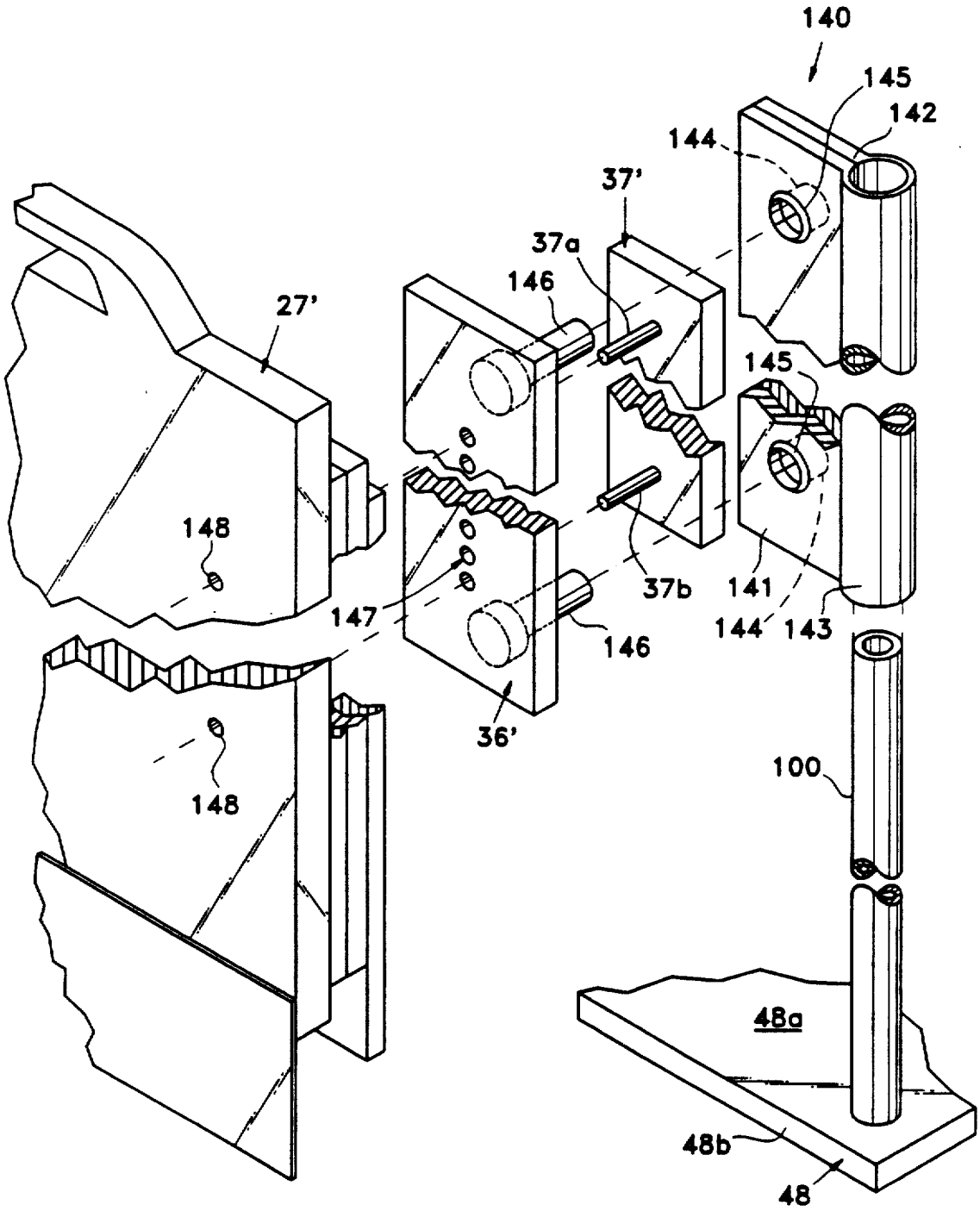
FIG. 10 is exploded view of a modification of the peg bar latching subassembly of FIGS. 1 and 5.

The above description contains several specific embodiment of the invention. They are not intended to be construed as limitations on the scope of the invention but merely examples of preferred embodiments. Persons skilled in the art can envision other obvious possible variations within the scope of the description. For example, the gate member 27 and pivot post 100 could be modified as shown in FIG. 10. As shown, the modified gate member 27' is increased in size to itself barricade the entire door opening of the rack when the gate member 27' is placed in a closed position. Such modification thus eliminates the need for a separate grille member of FIGS. 1 and 2. A modified hinge 140 is attached about the post 100 which is turn is attached to the upper surface 48*a* of the floor member 48. The modified hinge 140 has an elongated base 141 having a side 142 fitted with a tubular member 143. The tubular member 143 pivotally attaches to the post 100 but has an elongated end portion in contact with the upper surface 48*a* of the floor member 48. As a result at different, fixed heights relative to the floor member 48, a pair of receiving tubes 144 are provided at openings 145 of the base 141. They accept tubular members 146 of modified main peg bar 36' having vertically separated sets of openings 147 through which prongs 37*a*, 37*b* of auxiliary peg bar 37' extend in an annotated relationship. The prongs 37*a*, 37*b* are sized to fit within vertically separated openings 148 in the gate member 27' whereby variable gate height of the gate member 27' relative to the floor member 48 is easily achieved.

Although in the above-described modification the need for grille member 26 of FIGS. 1, 2 and 5 is completedly eliminated, note that the grille member 26 could be modified to attach directly to the base subassembly 30 instead of to the walls 20 of the rack 8. Hence the scope of the invention is to be determined by the appended claims and their legal equivalents.

What is claimed is:

1. A dispensing assembly for dispensing newspapers one-at-a-time from a newspaper rack having a windowed door disconnectably connectable to a coin-operatable latch mechanism, comprising (a) a base support including a gate member disconnectably connected relative to said base support whereby said gate member is at least pivotable relative thereto, (b) shaker means connected to said base support means and including a planar member capable of supporting a stack of newspapers including a deepest newspaper in surface contact therewith, and lever means capable of being provided with bi-directional, rectilinear travel relative to said base support, said lever means being fixedly connected to said planar member for providing corresponding travel of said planar member relative to said base support, (c) gate height adjustment means disconnectably connectable to said gate member for adjusting a height of said gate member relative to said planar member of said shaker means whereby a slot formed therebetween is correctly sized wherein uni-directional travel of a single newspaper therethrough is provided even though said lever and said planar member undergo bi-directional rectilinear travel relative to said base support.

2. In providing dispensing of newspapers one-at-a-time, the combination comprising a news rack of tetrahederal cross section including walls forming a central cavity and a windowed door pivotally attached relative to said walls, said windowed door being disconnectably connected to a coin-operatable latch mechanism having slots to accept coins to permit delatching of said windowed door relative to said walls, a dispensing assembly mounted within said news rack including (a) a base support mounted to said walls of said news rack, said base support including a gate member disconnectably connected to said base support whereby said gate member is at least pivotable relative to said base support, (b) shaker means connected to said base support and including a planar member capable of supporting a stack of newspapers within said cavity of said news rack, said stack of newspapers including a deepest newspaper in surface contact with said planar member, and lever means capable of being provided with bi-directional, rectilinear travel relative to said base support and news rack, said lever means being fixedly connected to said planar member for providing corresponding travel of said planar member relative to said base support, (c) gate height adjustment means disconnectably connectable to said gate member for adjusting a height of gate member relative to said planar member of said shaker means whereby a slot therebetween is correctly sized wherein uni-directional travel of a single newspaper of said stack of newspapers therethrough is provided even though said lever and said planar member undergo bi-directional rectilinear travel relative to said base support.

3. Method of dispensing of newspapers one-at-a-time, comprising the steps of moving the deepest newspaper in a horizontal stack of newspapers an incremental unidirectional distance relative to a slot formed between a gate member and a planar member of a shaker subassembly positioned within the walls of a news rack, said news rack being of tetrahederal cross section and including a central cavity defined by said walls and a windowed door pivotally attached relative to said walls, said windowed door being disconnectably connected to a coin-operable latch mechanism having slots to accept coins to permit delatching of said windowed door relative to said walls, after a grippable portion of said deepest newspaper that is viewable through said windowed door of said news rack, has been moved to a position exterior of said slot, activating said coin-operable latch mechanism so as to permit delatching of the windowed door relative to said walls, opening said windowed door of the news rack, extracting the deepest newspaper from the stack by grasping said grippable portion and pulling same relative to said slot.

4. The method of claim 3 with the precusor step of loading said news rack with a horizontal stack of newspapers by placing the central foldlines facing outward toward the windowed door of the news rack and with the deepest newspaper of the stack being in broad surface contact with the surface of the planar member of the shaker subassembly and being in substantial horizontal alignment with the slot formed between the gate member and the planar member.

5. The method of claim 4 in which in which the step of providing incremenal movement of the deepest newspaper is brought about by bi-directional movement of the planar member whose movement is controlled by a lever having a grip portion positioned exterior of the news rack.

6. The method of claim 5 in which the step of opening the windowed door of the news rack also activates a locking mechanism which locks said lever relative to said base support and prevents further bi-directional movement of said planar member.

7. The dispensing assembly of claim 1 in which said base support includes a planar floor member having a broad surface to which vertical a extending post is attached, a framing support also attached to said broad surface and roller means attached to said framing support in rolling contact with said planar member of said shaker means.

8. The dispensing assembly of claim 7 with the addition of spring means attached between said planar floor member and said planar member of said shaker means to provide downward loading of said planar member relative to said framing support.

9. The dispensing assembly of claim 1 in which said lever means includes a horizontally disposed grip portion to be grasped by a human, an end remote therefrom and a T-shaped vertically extending extension bar attached between said remote end and said planar member of said shaker means.

10. The dispensing assembly of claim 1 in which said gate height adjustment means includes a pair of first and second peg bars, said first peg bar having broad opposed surfaces interconceted by a series of openings and a pair of cylindrical members extending from one of said broad surfaces for fixed connection to said base support, said second peg bar having a pair of prongs mounted through a selected pair of said openings in said first peg bar into fixed contact with said gate member wherein height of said gate member relative to said planar member of said shaker means is adjusted so said slot therebetween is correctly sized wherein uni-directional travel of a single newspaper of said stack of newspapers therethrough is provided even though said lever and said planar member undergo bi-directional rectilinear travel relative to said base support.

11. The dispensing assembly of claim 10 with addition of a grille member fixedly supported relative to said base support, said grille member having a pair of horizontally aligned tubular members to receive said cylindrical members of said first peg bar, said gate member including a horizontal slot at an upper edge thereof into which said prongs of said second peg bar fixedly extend.

12. The dispensing assembly of claim 10 with addition of a hinge member having a base and a vertical tube at one edge of said base, said base having a broad surface and a pair of vertically aligned tubular members extending therefrom, said vertical tube having an inner surface in concentric contact about a vertically extending post on said base support and an end surface in contact with said base support, said tubular members of said base of said hinge member adapted to receive said cylindrical members of said first peg bar, said gate member including a pair of vertically aligned openings into which said prongs of said second peg bar fixedly extend.

13. The combination of claim 2 in which said base support includes a planar floor member having a broad surface to which vertically extending post on said base support is attached, a framing support also attached to said broad surface and roller means attached to said framing support in rolling contact with said planar member of said shaker means.

14. The combination of claim 13 with the addition of spring means attached between said planar floor member and said planar member of said shaker means to providing downward loading of said planar member relative to said framing support.

15. The combination of claim 2 in which said lever means includes horizontally disposed grip portion to be grasped by a human, an end remote therefrom and a T-shaped vertically extending extension bar attached between said remote end and said planar member of said shaker means.

16. The combination of claim 2 in which said gate height adjustment means includes a pair of first and second peg bars, said first peg bar having broad opposed surfaces interconnected by a series of openings and a pair of cylindrical members extending from one of said broad surfaces for fixed connection to said base support, said second peg bar having a pair of prongs mounted through a selected pair of said openings in said first peg bar into fixed contact with said gate member wherein height of said gate member relative to said planar member of said shaker means is adjusted so said slot therebetween is correctly sized wherein uni-directional travel of a single newspaper of said stack of newspapers therethrough is provided even though said lever and said planar member undergo bi-directional rectilinear travel relative to said base support.

17. The combination of claim 16 with addition of a grille member fixedly supported relative to said base support, said grille member having a pair of horizontally aligned tubular members to receive said cylindrical members of said first peg bar, said gate member including a horizontal slot at an upper edge thereof into which said prongs of said second peg bar fixedly extend.

18. The combination of claim 16 with addition of a hinge member having a base and a vertical tube at one edge of said base, said base having a broad surface and a pair of vertically aligned tubular members extending therefrom, said vertical tube having an inner surface in concentric contact about a vertically extending post on said base support and an end surface in contact with said base support, said tubular members of said base of said hinge member adapted to receive said cylindrical members of said first peg bar, said gate member including a pair of vertically aligned openings into which said prongs of said second peg bar fixedly extend.

19. The combination of claim 2 with the addition of locking mechanism activated by movement of said windowed door of said news rack for locking said lever relative to said base support and preventing further bi-directional movement of said planar member of said shaker means.

20. The combination of claim 19 in which said locking mechanism includes a pivot bar including a bracket at a mid-region thereof pivotally mounted to said base support, a series of slots at one end and a force conditioned-non-conditioned opposite end, said lever including a stud radially extendable into one of said series of slots as a function of the conditioned state at said opposite end of said pivot bar.

* * * * *